US012239194B1

(12) United States Patent
Marshall

(10) Patent No.: US 12,239,194 B1
(45) Date of Patent: Mar. 4, 2025

(54) WIG AND HAIR PIECE ORGANIZER

(71) Applicant: Semajia Marshall, Escondido, CA (US)

(72) Inventor: Semajia Marshall, Escondido, CA (US)

( * ) Notice: Subject to any disclaimer, the term of this patent is extended or adjusted under 35 U.S.C. 154(b) by 0 days.

(21) Appl. No.: 18/903,367

(22) Filed: Oct. 1, 2024

Related U.S. Application Data

(60) Provisional application No. 63/587,333, filed on Oct. 2, 2023.

(51) Int. Cl.
*A45D 44/04* (2006.01)
*A45C 11/26* (2006.01)
*A47F 7/06* (2006.01)

(52) U.S. Cl.
CPC ..... *A45C 11/26* (2013.01); *A47F 7/065* (2013.01)

(58) Field of Classification Search
CPC ..... A45C 11/26; A47F 7/065
USPC ..... 206/736
See application file for complete search history.

(56) References Cited

U.S. PATENT DOCUMENTS

| | | | |
|---|---|---|---|
| 8,439,210 | B1 | 5/2013 | Griffith |
| 8,727,110 | B2 | 5/2014 | Walsh |
| D723,741 | S | 3/2015 | Caplan |
| 9,339,138 | B2 | 5/2016 | Eslami et al. |
| 9,441,785 | B2 | 9/2016 | Sterling |
| 10,111,546 | B1 | 10/2018 | Springs et al. |
| 10,117,486 | B2 | 11/2018 | Cook |
| 10,306,970 | B2 | 6/2019 | Calabrese |
| 10,856,657 | B2 | 12/2020 | Felsenthal et al. |
| 11,529,004 | B2 | 12/2022 | Maducke |
| 2015/0129455 | A1 | 5/2015 | Williams |
| 2018/0228284 | A1 | 8/2018 | Gant |
| 2022/0378228 | A1 | 12/2022 | Johnson |

OTHER PUBLICATIONS

Hanging Jewelry Organizer,Accessories Organizer,80 Pocket Organizer for Holding Jewelries ( Beige, amazon.comhttps://www.amazon.com/brotrade-Hanging-Jewelry-Organizer-Jewelries/dp/B01CPHFN34/ref=asc_df_B01CPHFN34/?tag=hyprod-20&linkCode=df0&hvadid=198070680908&hvpos=&hvnetw= g&hvrand=14962853278695928562&hvpone=&hvptwo=&hvqmt=&hvdev=c&hvdvcmdl=&hvlocint=&hvlocphy=9026833&hvtargid=pla-350565867316&th=1 [Date accessed: Jun. 27, 2023].

Wig Bags Storage with Hanger—Packs Wig Storage for Multiple Wigs Hair Extension Storage Bag Hairpieces Storage Holder (Rose), amazon.com. https://www.amazon.com/3PCS-Hair-Extension-Storage-Bag/dp/B089N44T1G/ref=asc_df_B089N44T1G/?tag=hyprod-20&linkCode=df0&hvadid=459504271380&hvpos=&hvnetw=g&hvrand=2512060052617467101&hvpone=&hvptwo=&hvqmt=&hvdev=c&hvdvcmdl=&hvlocint=&hvlocphy=9028876&hvtargid=pla-945550638715&th=1 Date accessed: Jun. 27, 2023].

*Primary Examiner* — Andrew D Perreault
(74) *Attorney, Agent, or Firm* — Bold IP PLLC; Houda El-Jarrah

(57) ABSTRACT

A wig and hair piece holder/organizer is provided. The organizer includes four larger pockets to hold wigs. The four larger pockets have transparent covers with a central zipper for opening and closing the transparent cover for each individual pocket. A wig is placeable within the pocket and also can be hooked to or hung from an included grommet for each pocket. On a right side of the organizer, a top section of the organizer is divided into two individual pockets that include elastic holders for holding hair extensions and hair pieces. A set of four smaller pockets are integrated into the holder beneath the two top individual pockets on the right hand side. The back panel is made of satin. Further, the holder can be folded on itself and/or rolled to a compact storage state even while holding multiple wigs and/or hair extensions and styling tools.

11 Claims, 8 Drawing Sheets

WIG AND HAIR PIECE ORGANIZER

CROSS-REFERENCE TO RELATED APPLICATIONS

This application is a non-provisional application which claims priority to U.S. Provisional Patent Application No. 63/587,333, which was filed on Oct. 2, 2023, which is incorporated by reference in its entirety.

FIELD OF THE DISCLOSURE

The present invention relates to a wig and hair piece organizer to facilitate storage and easy access to wigs, hair pieces, and other hair related accessories.

BACKGROUND

People who wear wigs and hair pieces are aware that such items are expensive. Accordingly, it becomes imperative to properly store one's wig and hairpiece so as not to damage them. Existing organizers do not have the capacity to hold multiple wigs and/or hairpieces without the wigs and hairpieces becoming mixed together. Further, such organizers are not easily portable and easy to travel with, especially when a user has several wigs/hairpieces that need transportation.

Accordingly, there is a need for an improved wig and hair piece organizer.

SUMMARY

The present description includes one or more non-limiting embodiments for an apparatus comprising a holder for wigs, hair extensions, and hair styling tools and accessories. In a non-limiting embodiment, the holder comprises a first set of pockets located on a first left half of the holder, further comprising, two pockets having transparent covers in a first top row on a top side of the holder and two pockets having transparent covers located beneath the first row of the holder and on the first left half of the holder. The first set of pockets is particularly configured for receiving and storing one or more wigs that are visible through each transparent cover covering each pocket of the first set of pockets. The second set of pockets located on a top right half of the holder, wherein the second set of pockets comprises a first vertically elongated pocket and a second vertically elongated pocket wherein the first vertically elongated pocket and the second vertically elongated pocket further each comprise a vertically elongated cover that includes a set of fasteners to fasten the cover over an interior of the first vertically elongated pocket and the second vertically elongated pocket. There may also be at least one horizontal holder attached to a back surface of the first vertically elongated pocket and a back surface of the second vertically elongated pocket, wherein the at least one horizontal holder is configured to hold one or more hair extensions beneath the at least one horizontal holder and behind the vertically elongated cover for the first vertically elongated pocket and the second vertically elongated pocket. The holder may also comprise a third set of pockets positioned on a bottom right half of the holder, wherein each pocket of the third set of pockets comprises an individual cover, wherein each pocket of the third set of pockets further comprises: at least one horizontal holder for holding one or more hair styling tools or accessories. Further, the holder is foldable and collapsable along one or more integrated vertical and one or more horizontal fold lines included on a front and back surface of the holder.

The present description may further include the two pockets of the first set of pockets having transparent covers in the first row on the top side of the holder are positioned along a same row or level as the first vertically elongated pocket and the second vertically elongated pocket, and wherein the two pockets of the first set of pockets have a same length as the two pockets of the first vertically elongated pocket and the second vertically elongated pocket. Further, two pockets having the transparent covers located beneath the first row of the holder and on the first left half of the holder have a same length as the third set of pockets positioned on the bottom right half of the holder.

Additionally, each pocket of the first set of pockets comprises a zipper to open and close to access an interior of each pocket of the first set of pockets. The back surface of each pocket of the first set of pockets is made of or includes a satin material. The at least one horizontal holder may comprise elastic to make the first horizontal holder and the second horizontal holder stretchable. Further, the at least one horizontal holder for each pocket of the third set of pockets comprises elastic to make the at least one horizontal holder stretchable. The holder may further comprise a top hook attached to a back surface of the holder. Further, a left side strap is attached to a rear surface of the holder near a left edge of the rear surface of the holder and wherein a right side strap is attached to a rear edge of the rear surface of the holder, such that the left side strap is configured to be fasten around a left side of a separate hanger and wherein the right side strap is configured to fasten around a right side of the separate hanger in order to hang the holder using the removably attached separate hanger.

Other aspects and advantages of the invention will be apparent from the following description and the appended claims.

BRIEF DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure.

DETAILED DESCRIPTION

The present description includes exemplary embodiments for a unique wig and hairpiece organizer. Further details are provided in reference to the accompanying Figures.

Figure 1:
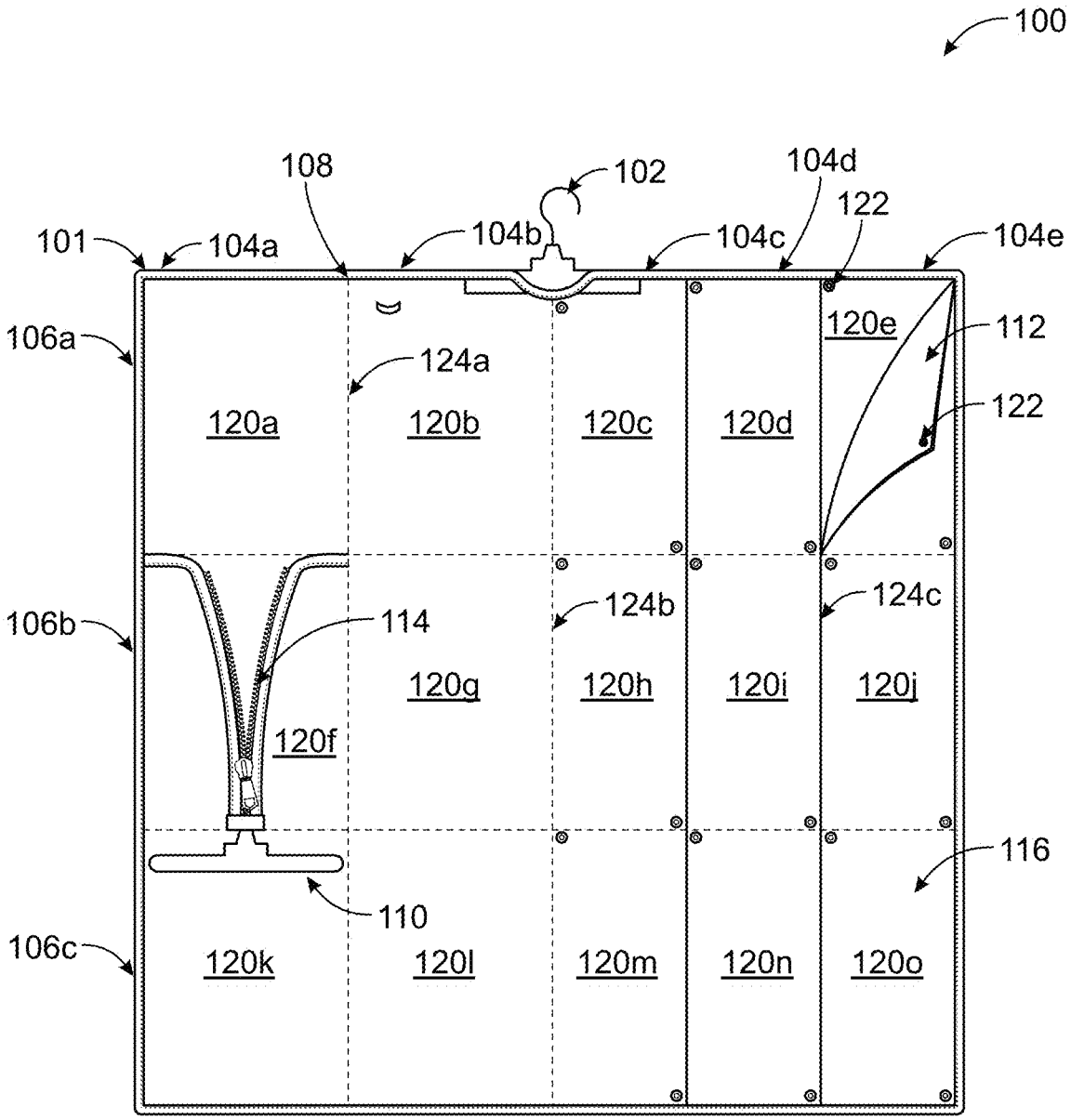
FIG. 1 is a pictorial illustration of a first embodiment of a wig and hairpiece holder/organizer.

FIG. 1 depicts an exemplary pictorial illustration of an exemplary wig and hairpiece holder 100 (hereinafter referred to as "holder"). The holder 100 may be composed of a back panel 101 that is then broken up into a series of columns 104*a*, 104*b*, 104*c*, 104*d*, and 104*e* and rows 106*a*, 106*b*, and 106*c* as shown in the non-limiting exemplary embodiment in FIG. 1. It is noted that in alternative embodiments there may be more or less columns 104 and rows 106 than those shown in FIG. 1. In a non-limiting embodiment, there may be at least 5 columns and 3 rows. In a non-limiting embodiment, each wig or hair piece or other accessory may be insertable into the individual pockets 120 (e.g., 120*a*-120*o*) of the holder 100. In a non-limiting embodiment, there may be at least 15 pockets 120, although there may be holders 100 with more or less pockets 120 to hold more or less items within the interiors of the pockets 120.

In a non-limiting embodiment, each pocket 120 and/or a majority of the pockets 120 may have an attached transparent cover 112 that can cover the pocket 120. It may be advantageous for each pocket 120 to have an attached transparent cover 112 so that the user can easily see through the transparent cover 112 to see which wig/hairpiece or other item is stored in the pocket 120 behind the transparent cover 112.

In a non-limiting embodiment, the transparent cover 112 may be snapped with corresponding buttons, snaps, or other fasteners 122, such as those shown on pocket 120*e*. In a non-limiting embodiment, only the right side including about 9 pockets 120 of the holder 100 may have covers 112 that can snap open and close using snaps 122.

In other embodiments, the cover 112 may include a zipper 114, such as that shown in FIG. 1 on pocket 120*f*. Having the detachable snaps, fasteners (e.g. 122), and/or zippers 114 for each transparent cover 112 is an advantage because then each wig or hairpiece or other accessory can be stored securely within the pocket 120 behind the transparent cover 112.

It may be preferable that the entire interior back portion 116 of the holder 100 may be made of satin so that the wigs, hairpieces, or other hair accessories are properly preserved and stored within each pocket 120. Satin helps to minimize breakage of the hairs of the wigs or hairpieces. In a non-limiting embodiment, bright colors may be used for the satin interior backing, including, but not limited, to turquoise.

In a non-limiting embodiment, at least one pocket 120 includes a detachable pocket hanger 110 such as that shown in pocket 120*k*. In this way, the user can easily detach the entire wig/hairpiece as still held by the detachable hanger 110 from one or more pockets 120. The holder 100 may have more than one pocket 120 that has a detachable pocket hanger 110 in alternative embodiments. In a non-limiting embodiment, only the pockets 120 that have zippers may also have detachable pocket hangers 110.

Further, and advantageously, the top edge of the holder 100 may include a detachable hanger 102 so that the user can easily hang the entire holder 100 on a rod or hook or another element. Further, if the user does not need to include the detachable top hanger 102 for purposes of packing and/or folding flat the holder 100, the user can easily remove the detachable top hanger 102.

In a non-limiting embodiment, the holder 100 includes one or more foldable creases 124 for the user to fold the holder 100 along the designated creases 124. In a non-limiting embodiment, the holder 100 may include a foldable crease 124 along each intersection between each column 104 and row 106, including creases 124*a*, 124*b*, and 124*c*. The foldable creases 124 would be pre-formed and created so that the user may easily fold the holder 100 one or more times at the designated creases 124. In a non-limiting embodiment, the holder 100 is able to fold vertically at least one time, such as along the crease 124*b*, so that the holder 100 can fold in half.

Further, in another non-limiting embodiment, the holder 100 may be able to fold onto itself horizontally another two times to create a collapsed, compact effect.

In a non-limiting embodiment, as shown in FIG. 1, some pockets 120 may have different overall dimensions. Some pockets 120, for example, may be 9 inches by 18 inches wide, while other pockets 120 may be 6 inches by 18 inches wide. This may be useful for the user to choose pockets 120 that properly fit a wig and/or hair piece based on the overall size/width of the wig or hairpiece.

Figure 2:
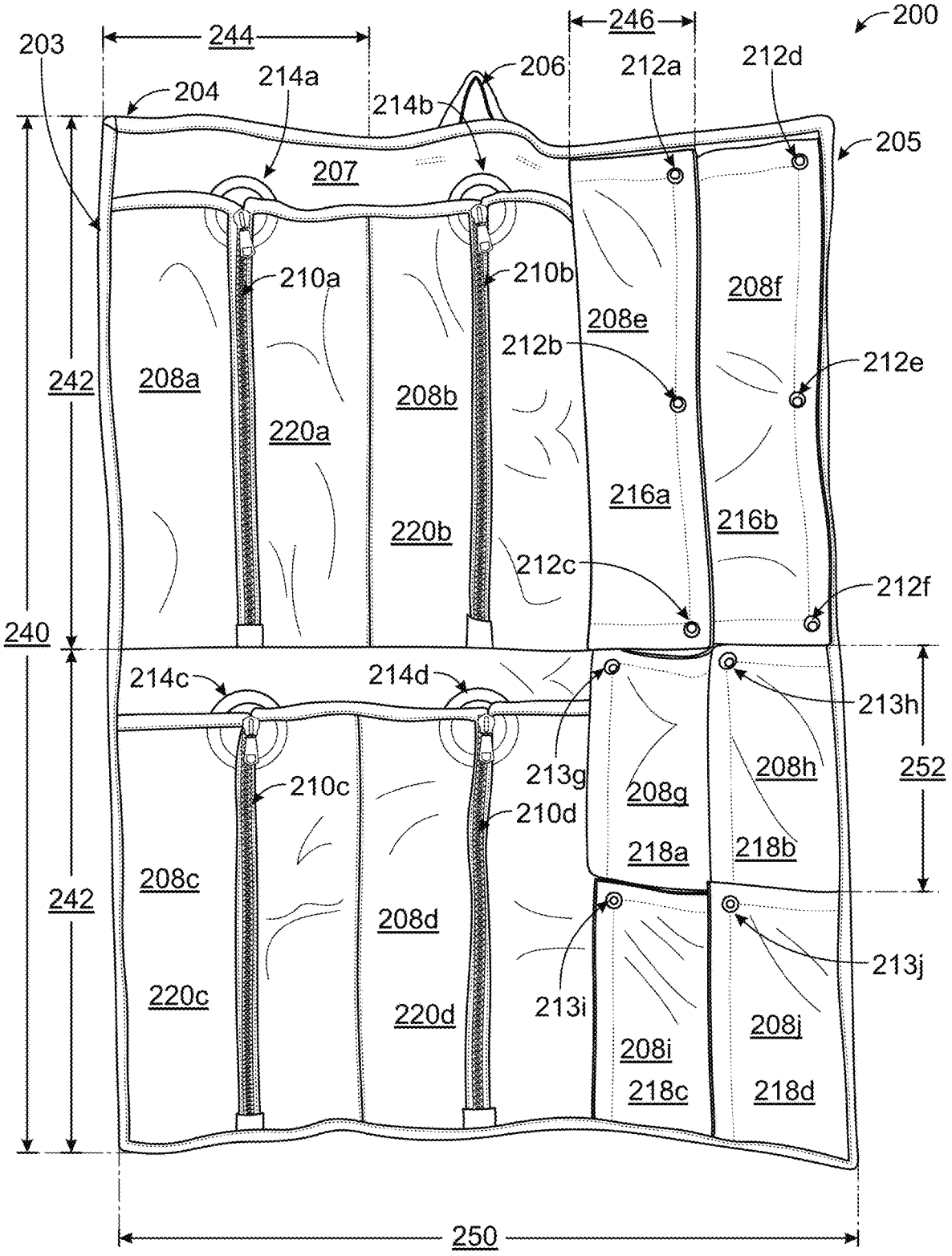
FIG. 2 is a pictorial illustration of a second embodiment of a wig and hairpiece holder/organizer from a front view.
Figure 3:
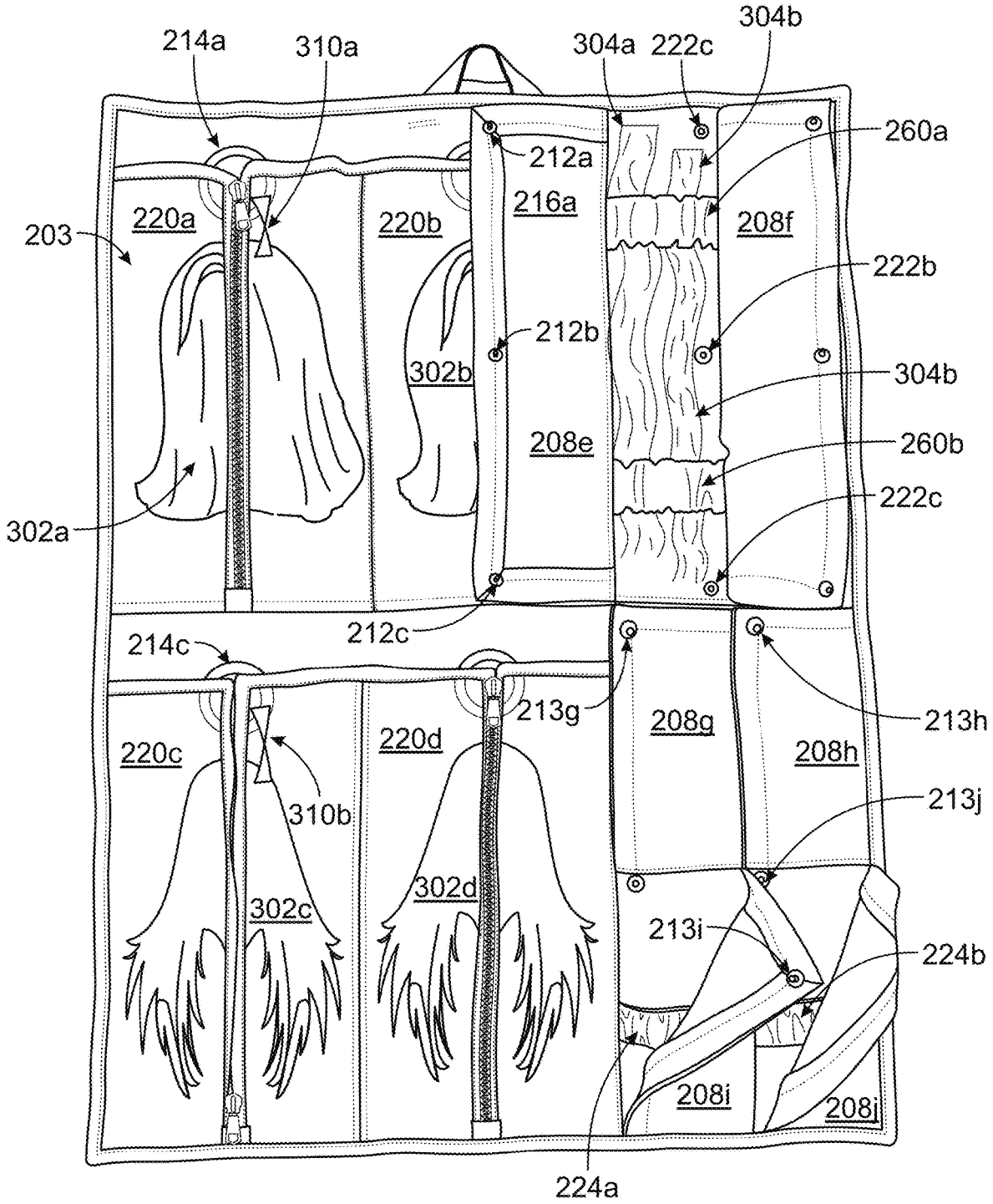
FIG. 3 is a pictorial illustration of the wig and hairpiece holder/organizer shown in FIG. 2 with one or more pockets opened.

FIGS. 2-7 display a second embodiment of a wig and hair piece organizer/holder 200. The wig and hair piece organizer/holder (WHPOH) 200 as shown in FIGS. 2-7 is similar in form and purpose to the WHPOH 100 shown in FIG. 1 in that the organizer 200 is able to hold wigs (e.g., wigs 302 as shown in FIG. 3) and hair extensions or individual hair attachments that are not a full wig (e.g., hair pieces 304 as shown in FIG. 3) in place and in an organized manner in such a way that the wigs 302 and hair pieces 304 are easy to see. Further, one or more hair tools, such as brushes, combs, hair accessories, hair styling tools, and/or other hair related products may also be stored in one or more designated pockets or spots included in the WHPOH 200.

Figure 5:
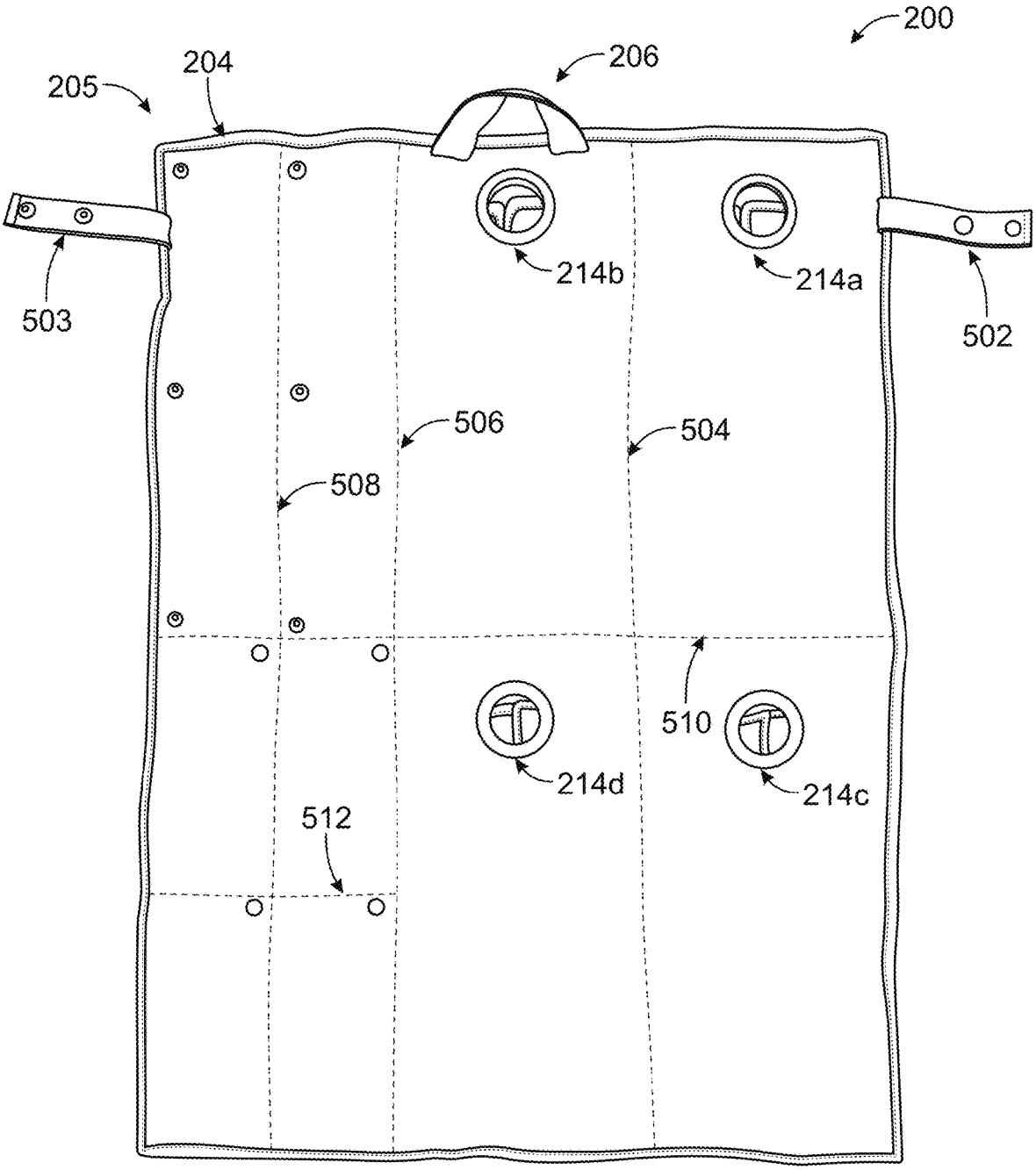
FIG. 5 is a pictorial illustration of the wig and hair piece holder/organizer shown in FIG. 2 shown from a back view.
Figure 6:
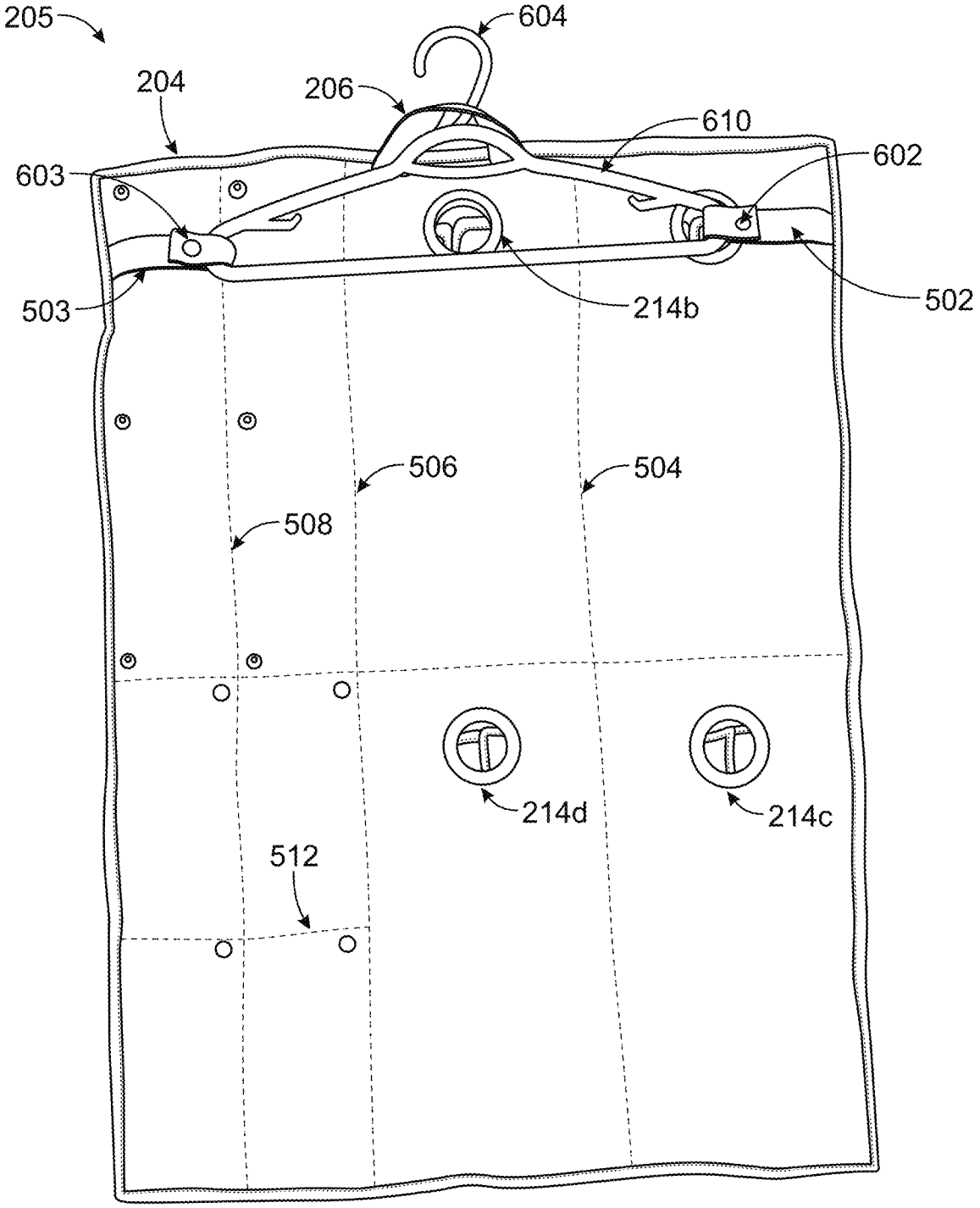
FIG. 6 is a pictorial illustration of another rear view of the wig and hair piece holder/organizer shown in FIG. 2.
Figure 7:
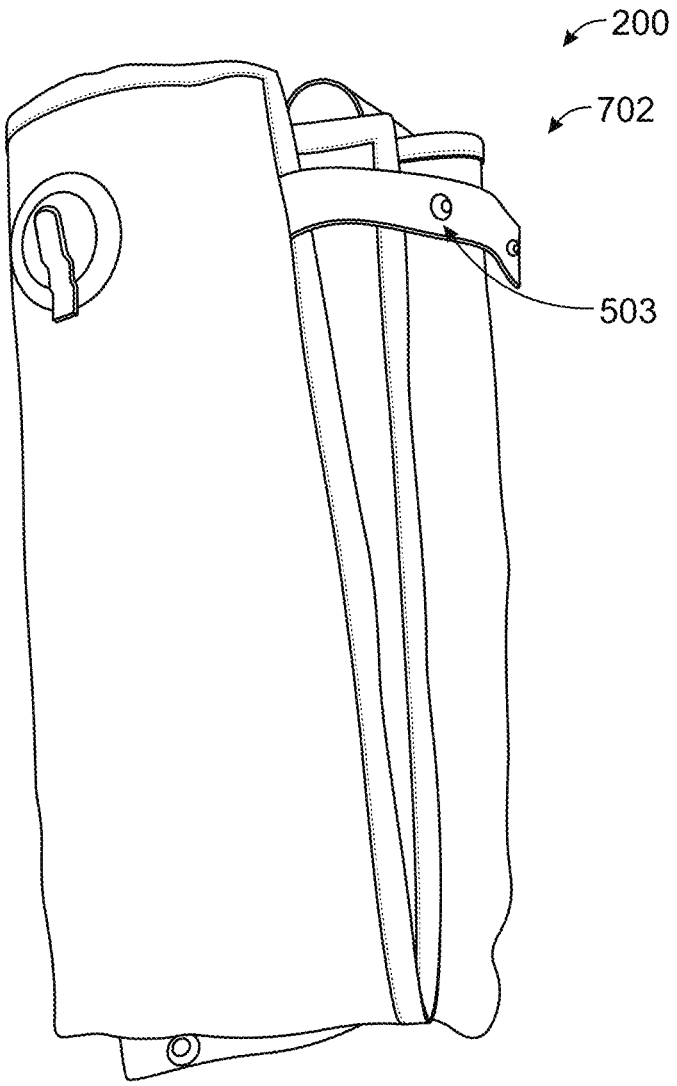
FIG. 7 is a pictorial illustration of the wig and hair piece holder/organizer shown in FIG. 2 shown rolled up in a storage position.

FIG. 2 and FIG. 3 show pictorial illustrations of the front side 203 of the body 204 of the WHPOH 200. FIG. 5 and FIG. 6 show pictorial illustrations of the rear side 205 of the body 204 of the WHPOH 200. FIG. 7 shows how the WHPOH 200 may be rolled up fully and tightened to close and to hold a number of wigs 302 and/or hair pieces 304 and other hair styling tools in one or more non-limited embodiments in a manner that is easier to pack in a bag or suitcase for travel or storage or later use.

Turning to FIG. 2, the organizer 200 includes a top hook 206 that can be used to hang the entire organizer 200 or the top hook 206 may be used as a handle alternatively in some cases. The body 204 of the organizer 200 is generally rectangular with a number of pockets and dividers with unique configurations and formats. The top hook 206 may be made of a fabric or a combination of fabric or plastic or metal.

In a non-limiting embodiment, the body 204 of the organizer 200 comprises individual pockets or sections 208 dedicated in particular for holding wigs 302. In a non-limiting embodiment, the organizer 200 may have four pockets or sections 208. As shown in FIG. 2, the pockets or sections shown are 208*a*, 208*b*, 208*c*, and 208*d*. Pocket 208*a* is separated and divided from pocket 208*b* and are positioned on a top row together in the organizer 200. Pocket 208*c* is separated and divided from pocket 208*d* and positioned on a bottom row together beneath the top two pockets 208*a* and 208*b*.

In a non-limiting embodiment, there may be a grommet 214*a*, 214*b*, 214*c*, and 214*d* included in each pocket or section 208*a*, 208*b*, 208*c*, and 208*d*, respectively. In a non-limiting embodiment, the central hole shown for each grommets 214*a*, 214*b*, 214*c*, and 214*d* may be open and do not have a closed back surface such that it is possible to see through the grommets 214*a*, 214*b*, 214*c*, and 214*d* when looking through the grommets 214 from either the front surface 203 of the organizer 200 or the back surface 205. In other embodiments, there may be a closed backing preventing the grommets 214 from being see through from the front 203 to the back surface 205 or vice versa.

The front of the pocket or sections 208*a*, 208*b*, 208*c*, and 208*d* may be transparent so that anyone can look into the pocket or section 208*a*, 208*b*, 208*c*, and 208*d* when looking directly at the body 204 of the organizer 200 and the specific wig 302 that is held inside of the pocket or sections 208*a*, 208*b*, 208*c*, or 208*d* is visible from the outside. There may also be a zipper 210*a*, 210*b*, 210*c*, and 210*d* that is generally centrally placed and incorporated on the pocket or sections 208*a*, 208*b*, 208*c*, or 208*d*. The user can unzip and zip the zippers 210*a*, 210*b*, 210*c*, and 210*d* in order to store or place the wigs 302 inside each respective pocket 208*a*, 208*b*, 208*c*, and 208*d*.

Advantageously, the user can hang the wig 302 stored within each pocket or section 208 using a hook 310 that is either permanently attached or removably attached to the respective grommet 214. Examples of such hooks are shown in FIG. 3, as hooks 310*a* and 310*b* which can each respectively hold a wig 302, for example, hooked to one or more grommets 214*a* or 214*b* (or also 214*c* and 214*d*). Because of the inclusion of the grommets 214 and the exemplary double clip hooks 310, the user can remove the wig 302 by unhooking the wig from the hook (e.g. 310*a* and 310*b*) or unhook the entire hook 310 and wig 302 from the grommet 214 and remove them as a whole together from the organizer 200 such that the user can style the wig 302 while the wig 302 or other items (e.g. hair extensions 304) are still attached to the hooks 310. This may help the user to be able to more easily pick up the wig 302 and/or style the wig 302 if the wig 302 is clipped to the hooks 310 when the user removes the wig 302 from the organizer 200.

The wigs 302 can advantageously be placed in each larger section or pocket 208*a*, 208*b*, 208*c*, 208*d* in such a way that the wigs 302 are protected by the transparent covers 220*a*, 220*b*, 220*c*, and 220*d* on each section or pocket 208*a*, 208*b*, 208*c*, and 208*d*. as shown for example in FIG. 2. Each side of the preferably transparent cover 220*a*, 220*b*, 220*c*, and 220*d* may be divided by a central zipper, such as zippers 210*a*, 210*b*, 210*c*, and 210*d*. The user may unzip each zipper 210*a*, 210*b*, 210*c*, and 210*d* to access the interior of each larger section or pocket 208*a*, 208*b*, 208*c*, and 208*d* of the organizer 200 in order to place a wig 302 for storage or to remove such a wig 302. The wigs 302 may also be hooked onto one or more hooks 310 that clip onto the grommets 214 included in each larger section or pocket 208 of the organizer 200.

Figure 4:
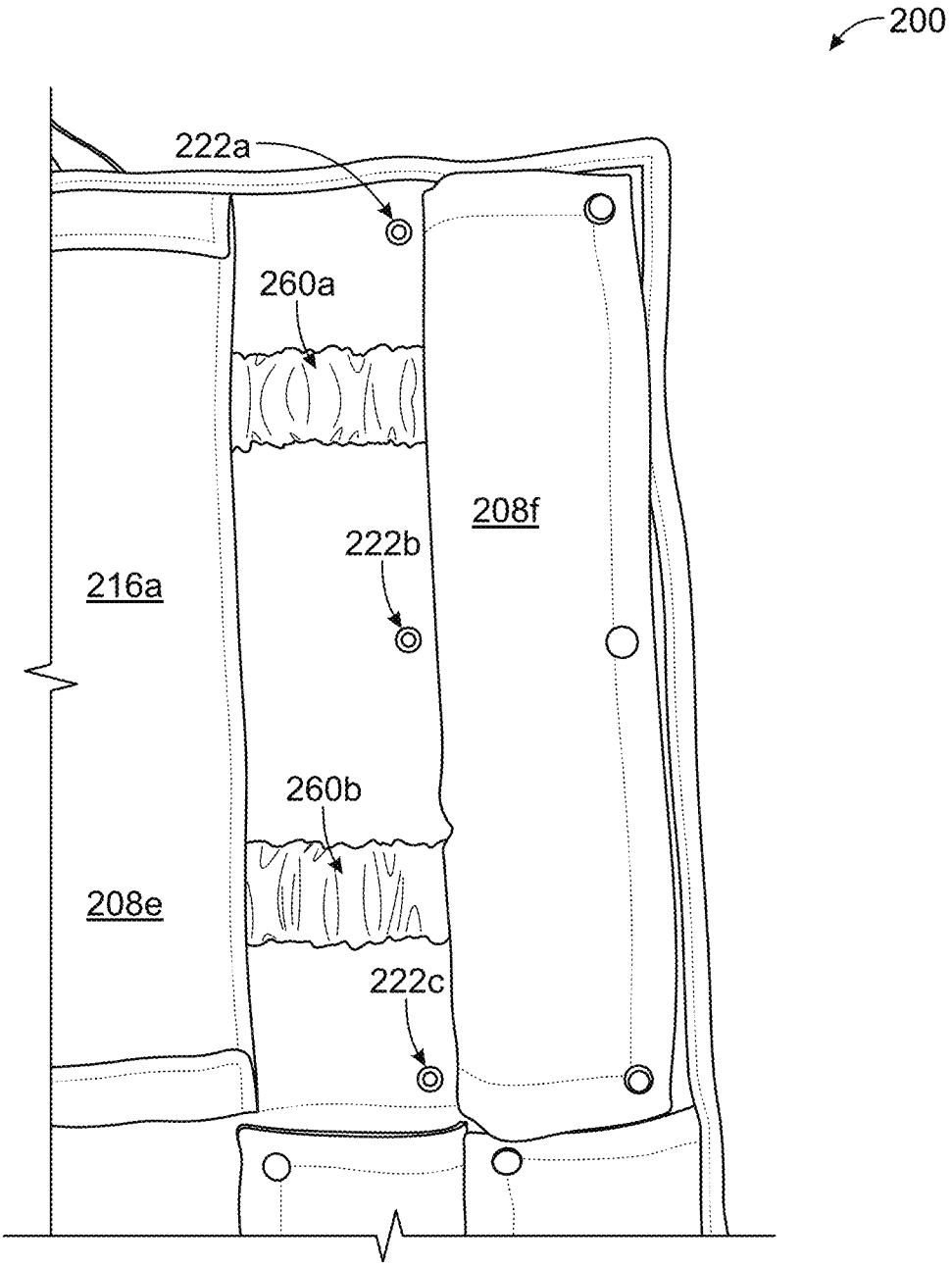
FIG. 4 is a pictorial illustration with a close up view of one or more pockets of the wig and hair piece holder/organizer shown in FIG. 2 in an open position.

The organizer 200 also includes a different arrangement of sections or pockets, shown as sections or pockets 208*e* and 208*f* on a right side of the organizer 200. As shown in FIG. 2, there are two sections or pockets 208*e* and 208*f* whose front covers 216*a* and 216*b* can be opened and closed to access the interior via snaps or buttons, such as snaps 212*a*, 212*b*, 212*c*, 212*d*, 212*e*, and 212*f*. FIG. 3 and FIG. 4 show views of an exemplary interior view of pocket 208*e* and exterior view of pocket 208*f* for comparison. In a non-limiting embodiment, the pockets 208*e* and 208*f* may be particularly useful for holding in place hair extensions such as hair extensions 304*a* and 304*b* as shown in FIG. 3. As noted above, hair extensions such as hair extensions 304*a* and 304*b* may be pieces of hair (synthetic or real) that are clippable or otherwise attachable to a user's head and that may not amount to a full wig. The hair extensions 304 may be a smaller amount of hair that can be added in one or more sections onto a user's head of hair or head. The pockets 208*e* and 208*f* may be particularly suitable for holding such hair extensions 304. The front covers 216*a* and 216*b* of the pockets 208*e* and 208*f* as shown in FIG. 2 and in FIG. 3. can be unsnapped or unbuttoned and opened and closed in a door like manner over the interior of the pockets 208*e* and 208*f*. FIG. 3 shows an exemplary back view of the front cover 216*a* when it is opened and the interior of pocket 208*e* is exposed with the exemplary horizontal holders 260*a* and 260*b* and exemplary hair extensions 304*a*, 304*b* located within the confines of the horizontal holders 260*a* and 260*b* and the interior of the pocket 208*e*. The user is able to close the front cover 216*a* and connect the fasteners 212*a*, 212*b*, 212*c* to their corresponding mating fasteners 222*a*, 222*b*, and 222*c* which are located along a side edge of pocket 208*e* to enable the user to protect the hair extensions 304*a*, 304*b* held or contained therein. In a non-limiting embodiment, the larger sections or pockets 208*e* and 208*f* each have one or more horizontal holders 260*a* and 260*b* as shown in FIG. 3.

In a non-limiting embodiment, the pockets 208*e* and 208*f* may include horizontal holders 260*a* and 260*b*. The horizontal holders 260*a* and 260*b* are vertically spaced apart within the interior of the pockets 208*e* and 208*f* as shown in FIG. 2. Each holder 260*a* and 260*b* may be useful for holding in place a portion of the hair extensions 304*a* and 304*b* such that the hair extensions 304*a* and 304*b* can be held upright within the interior of the pockets 208*e* and 208*f* such that the hair extensions 304*a* and 304*b* are stored in a neat manner. Advantageously, the holders 260*a* and 260*b* will prevent the hair extensions 304*a* and 304*b* from falling apart and ruining the look and quality of the hair extensions 304*a* and 304*b* while the hair extensions 304 are stored within the holders 260*a* and 260*b* of the organizer 200.

In a non-limiting embodiment, the organizer 200 includes four smaller sections or pockets shown as pocket 208*g*, 208*h*, 208*i* and 208*j* as shown in FIG. 2 and in FIG. 3. As shown in FIG. 3. The pockets 208*g*, 208*h*, 208*i*, and 208*j* each have a smaller front cover 218*a*, 218*b*, 218*c*, and 218*d* with one or more corner snaps 213*g*, 213*h*, 213*i*, 213*j* so that the front cover 218*a*, 218*b*, 218*c*, and 218*d* of each pocket 208*g*, 208*h*, 208*j*, and 208*j*, respectively, can be opened diagonally to access the interior of the pockets 208*g*, 208*h*, 208*i*, and 208*j*. In a non-limiting embodiment, each pocket 208*g*, 208*h*, 208*i*, and 208*j* includes a holder 224*a* that can be used to secure one or more hair styling tools, such as combs or brushes or hair styling products. The front covers 218*a*, and 218*b* only cover the interior of pockets 208*g*, 208*h*, 208*i*, and 208*j* respectively and do not need to be transparent in one or more non-limiting embodiments, although it may be possible that they are transparent in other embodiments.

In a non-limiting embodiment, the horizontal holders 220*a*, 220*b*, and 224*a* may be made of elastic material that integrates other types of materials and/or fabric. The elastic may be used to easily pull the horizontal holders 220*a*, 220*b*, and 224*a* away from a back surface of the respective pockets in the organizer 200 so the user can add or remove an item such as a hair extension 304 or a hair styling tool.

In a non-limiting embodiment, as shown in FIG. 2, the width 250 of the organizer 200 may be approximately 24 inches wide while the length 240 of the organizer 200 is approximately 33 inches long. In a non-limiting embodiment, a width 244 of each wig holder or pocket 208*a*, 208*b*, 208*c*, and 208*d* may be approximately 8 inches wide and a length 242 of each pocket 208*a*, 208*b*, 208*c*, and 208*d* may be approximately 16.5 inches long. The length 240 of approximately 16.5 inches long may be useful to accommodate longer length wigs 302 as well as shorter length wigs 302. In a non-limiting embodiment, a width 246 of the pockets 208*e* and 208*f*, which may be particularly suited for holding hair extensions/sections of hair 304 may be approximately 4 inches wide. The length 242 of the pockets 208*e* and 208*f* may be the same as the length 242 of the pockets 208*a*, 208*b* (which are along the same row of the holder 200) and may be approximately 16.5 inches long.

In a non-limiting embodiment, the lower right hand section of the organizer 200 is divided into four smaller pockets 208*g*, 208*h*, 208*i*, and 208*j* as discussed above which are positioned on a lower right half of the organizer 200. The four smaller pockets 208*g*, 208*h*, 208*i*, and 208*j* may each be approximately 4 inch wide (e.g., 246) and approximately 8.25 inches long (e.g. 252) in a non-limiting embodiment. Other variations may be possible in terms of size and dimensions in alternative embodiments.

Notably, pockets 208*a* and 208*b* are the same length 242 as the length 242 of the second set of pockets 208*e* and 208*f* as shown in FIG. 2. Further, the length 242 of the pockets 208*c* and 208*d* are the same overall length of the bottom set of pockets 208*g*, 208*h*, 208*i* and 208*j*, even though each individual pocket 208*g*, 208*h*, 208*i*, and 208*j* may each have its own smaller length 252 of approximately 8.25 inches. In this manner, different sizes and arrangement of pockets 208*a*, 208*b*, 208*c*, 208*d*, 208*e*, 208*f*, 208*g*, 208*h*, 208*i*, and 208*j* are provided for on a front surface 203 of the organizer 200 to hold a variety of wigs 302, hair extensions/pieces/individual hair pieces 304, and/or hair styling tools and accessories in an organized and secure manner.

It is noted that in a non-limiting embodiment, the interior back surface 207, as shown for example in FIG. 2, of the organizer 200 may be lined with satin material on an interior surface of all the pockets 208*a*, 208*b*, 208*c*, 208*d*, 208*e*, 208*f*, and/or 208*g*, 208*h*, 208*i*, and 208*j*. The satin material may be useful for preventing breakage or wear and tear on the sensitive hairs of the wigs 302 and/or hair extensions 304 instead of plastic or another coarse fabric.

FIG. 5 and FIG. 6 both reflect exemplary rear views of the back surface 205 of the organizer 200. The organizer 200 may include a top hook 206 that is attached to a top edge of the rear surface of the organizer 200. The top hook 206 may usefully be used to hang the organizer 200 on a hanging element such as a hook or other element. Alternatively, a hanger, such as hanger 610 shown in FIG. 6, can be inserted into the hole or opening of the top hook 206 and the organizer 200 and the hook 604 of the hanger 610 together may be used to hang the organizer 200 securely to another hook or bar.

The organizer 200 may include a left side strap 502 and a right side strap 503. The left side strap 502 and the right side strap 503 may be attached to a back surface 205 of the organizer 200 (e.g. via sewing or another method of attachment). As shown in FIG. 6, in a non-limiting embodiment, the left side strap 502 and right side strap 503 may each include one or more snaps 602, 603. The snaps 602, 603 can be used to position each side strap 502, 503 around a left and a right side end of the hanger 610 to securely and removably hold a separate hanger 610 in place on a back surface of the organizer 200 and to allow the hook 604 of the hanger 610 to be inserted into the opening of the top hook 206.

Additionally, as shown in FIG. 5 and FIG. 6, the organizer 200 includes one or more integrated vertical fold lines 504, 506, 508 and/or horizontal fold lines 510, 512 so that the organizer 200 can be fully folded along the various fold lines 504, 506, 508, 510, 512 to a compact size, including when the organizer 200 is full of wigs 302, hair extensions 304, and/or styling tools that are placed in their respective pockets on a front surface 203 of the organizer 200. The fold lines 504, 506, 508, 510, and 512 are part of the ability to fold the organizer 200 vertically and horizontally along the fold lines 504, 506, 508, 510, and 512 and also allow the final product to be folded to fully compact state as shown in FIG. 7.

FIG. 7 shows an example of how the organizer 200 is folded to a fully compact state in order to enable the organizer 200 to be reduced in size and easily stored or packed. The organizer 200 can then be unfolded and restored to its fully expanded state as shown for example in FIGS. 2-6. In a non-limiting embodiment, the storage holder 200 may be rolled as well closed.

Hair extensions 304 and/or wigs 302 can be very expensive and valuable to the user. Further, hair extensions 304 and/or wigs 302 can be easily damaged. The ability to carefully and safely store the wigs 302 and hair extensions 304 in the organizer 200 is extremely valuable and much needed. The hair and wig organizer 200 are designed to ensure that a user can place their valuable wigs 302 and/or hair extensions 304 and other styling tools in a safe and secure manner within the organizer 200. In a non-limiting embodiment, there may be additional straps or fasteners to adjust a tightness of the holder 200 when stored in a closed position to accommodate the number of products contained within the holder 200. This may allow the holder 200 to be loosened or tightened as needed for accommodating storage of the wigs 302, hair extensions 304, and other items.

Figure 8:
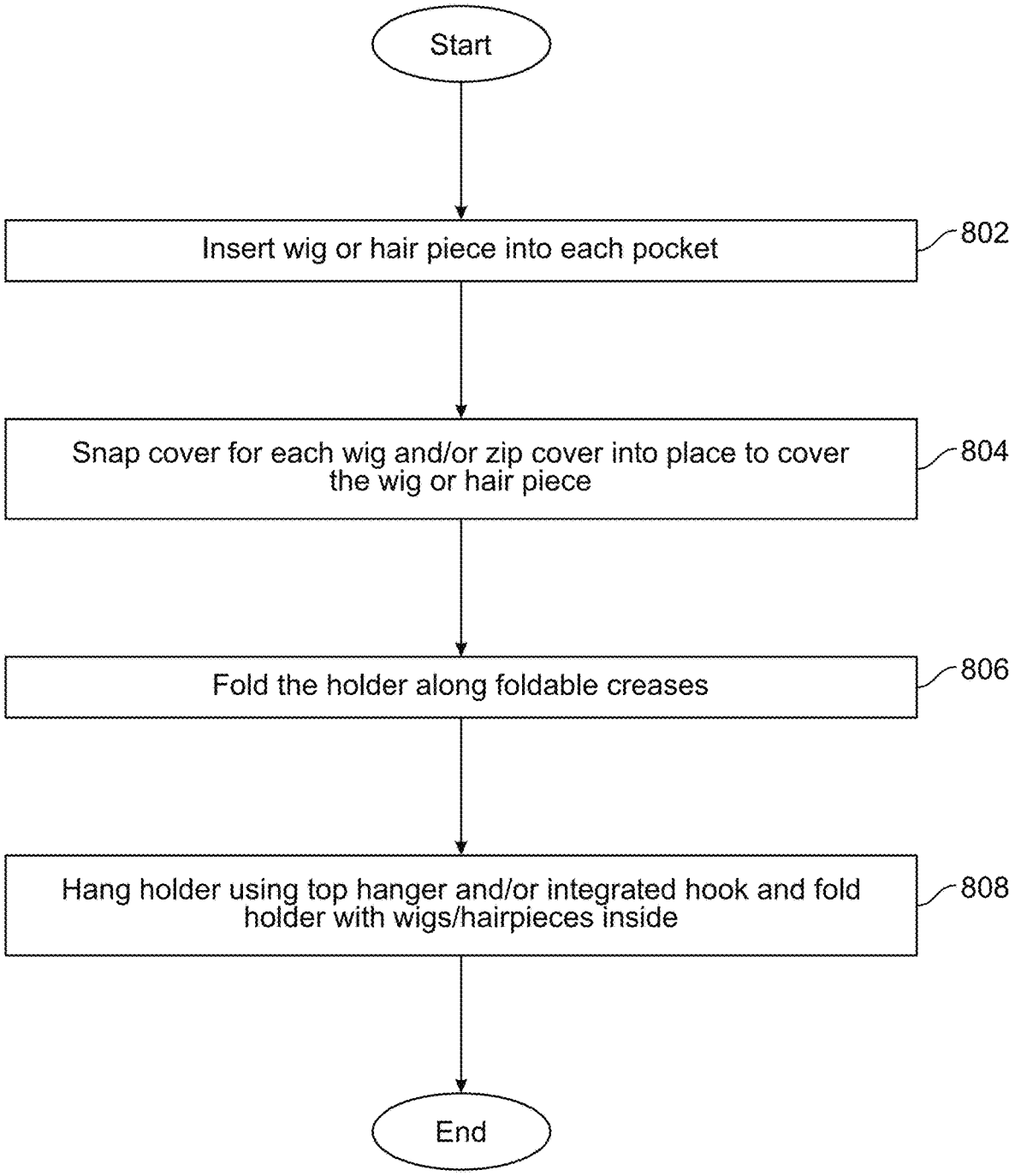
FIG. 8 is a flowchart of a method of use of a wig and hairpiece holder/organizer.

FIG. 8 is a flowchart for an exemplary method of how to use a wig/hairpiece holder 100 or 200 in accordance with one or more non-limiting embodiments. At step 802, the user may insert a wig or hair piece into each pocket of the holder 200. Repeat this step as needed. Further, as shown at step 804, the user may securely insert or place any wigs/hairpieces into the holder 200 by snapping or zipping a cover on each pocket (e.g. pockets 208*a*, 208*b*, 208*c*, 208*d*, 208*e*, 208*f*, 208*g*, 208*h*, 208*i*, 208*j*). At step 806, the user may fold the holder over the foldable creases or folds (e.g., as shown in FIG. 5 and in FIG. 6). At step 808, the user may transport the holder 100 or 200 in a folded, compact state as shown for example in FIG. 7. Further, the user can unfold the holder or organizer 100 or 200 and hang the holder or organizer 100 or 200 via an included top hanger 102, for example, or top hook 206 as shown for FIG. 2, or hook 604 of a hanger 610 as shown in FIG. 6.

Advantageously, the holder 100/200 is specifically designed to hold many wigs 302 and/or hair extensions or hair pieces 304 to make it easier for the user to transport and/or pack or store the holder 100 and 200 and to also display the wigs 302 and hair pieces 304 for easy access. Advantageously, the holder 200 has several pockets with transparent covers (e.g. covers 220*a*, 220*b*, 220*c*, and 220*d*) so that the user can easily see through the transparent covers and visually ascertain which wig or hair piece is contained within the pocket of the organizer 100/200.

Many other uses and advantages are offered by the wig and hair piece organizer/holder 100 or 200 as described above in one or more non-limiting embodiments in the present description.

In the Summary above and in this Detailed Description, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, steps, among others, are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "set" as used herein may refer to one or more items. Accordingly, "set" may mean a single item or more than one item.

The term "at least" followed by a number is used herein to denote the start of a range beginning with that number (which may be a range having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)–(a second number)," this means a range whose lower limit is the first number and whose upper limit is the second number. For example, 25 to 100 mm means a range whose lower limit is 25 mm and upper limit is 100 mm.

Certain terminology and derivations thereof may be used in the following description for convenience in reference only and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention.

The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed is:

1. An apparatus comprising:

a holder for wigs, hair extensions, and hair styling tools and accessories, the holder comprising:

a first set of pockets located on a first left half of the holder, further comprising, two pockets having transparent covers in a first top row on a top side of the holder and two pockets having transparent covers located beneath the first row of the holder and on the first left half of the holder, wherein the first set of pockets is particularly configured for receiving and storing one or more wigs that are visible through each transparent cover covering each pocket of the first set of pockets;

a second set of pockets located on a top right half of the holder, wherein the second set of pockets comprises a first vertically elongated pocket and a second vertically elongated pocket wherein the first vertically elongated pocket and the second vertically elongated pocket further comprise:

a vertically elongated cover that includes a set of fasteners to fasten the vertically elongated cover over an interior of the first vertically elongated pocket and an interior of the second vertically elongated pocket; and at least one horizontal holder attached to a back surface of each pocket of the second set of pockets, wherein the at least one horizontal holder is configured to hold one or more hair extensions beneath the at least one horizontal holder and behind the vertically elongated cover for each pocket of the second set of pockets; and a third set of pockets positioned on a bottom right half of the holder, wherein each pocket of the third set of pockets comprises an individual cover, wherein each pocket of the third set of pockets further comprises:

at least one horizontal holder for holding one or more hair styling tools or accessories; and wherein the holder is foldable and collapsable along one or more integrated vertical and one or more integrated horizontal fold lines included on a front surface and a back surface of the holder.

2. The apparatus of claim 1, wherein the two pockets of the first set of pockets having transparent covers in the first row on the top side of the holder are positioned along a same row or level as the first vertically elongated pocket and the second vertically elongated pocket, and wherein the two pockets of the first set of pockets have a same length as the two pockets of the second set of pockets.

3. The apparatus of claim 1, wherein the two pockets having the transparent covers located beneath the first row of the holder and on the first left half of the holder have a same length as the third set of pockets positioned on the bottom right half of the holder.

4. The apparatus of claim 1, wherein each pocket of the first set of pockets comprises a zipper to open and close to access an interior of each pocket of the first set of pockets.

5. The apparatus of claim 1, wherein a back surface of each pocket of the first set of pockets is made of or includes a satin material.

6. The apparatus of claim 1, wherein the at least one horizontal holder of the second set of pockets comprises elastic to make the at least one horizontal holder stretchable.

7. The apparatus of claim 1, wherein the at least one horizontal holder for each pocket of the third set of pockets comprises elastic to make the at least one horizontal holder stretchable.

8. The apparatus of claim 1, wherein the holder further comprises a top hook attached to the back surface of the holder.

9. The apparatus of claim 1, wherein a left side strap is attached to a rear surface of the holder near a left edge of the rear surface of the holder and wherein a right side strap is attached to the rear surface of the holder near a right edge of the rear surface of the holder.

10. The apparatus of claim 9, wherein the left side strap is configured to be fasten around a left side of a removably attachable separate hanger and wherein the right side strap is configured to fasten around a right side of the removably attachable separate hanger in order to hang the holder using the removably attachable separate hanger.

11. The apparatus of claim 1, wherein an upper area of each pocket of the first set of pockets has a grommet such that a clip or the like may removably attach to the grommet and the one or more wigs.

* * * * *